US008366837B2

(12) United States Patent
Wakabayashi et al.

(10) Patent No.: US 8,366,837 B2
(45) **Date of Patent: *Feb. 5, 2013**

(54) POWDER MAGNETIC CORE AND MAGNETIC ELEMENT USING THE SAME

(75) Inventors: Yuya Wakabayashi, Hyogo (JP); Takeshi Takahashi, Kyoto (JP); Nobuya Matsutani, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/255,615

(22) PCT Filed: Jan. 14, 2010

(86) PCT No.: PCT/JP2010/000152

§ 371 (c)(1),
(2), (4) Date: Sep. 9, 2011

(87) PCT Pub. No.: WO2010/103709

PCT Pub. Date: Sep. 16, 2010

(65) Prior Publication Data

US 2012/0001710 A1 Jan. 5, 2012

(30) Foreign Application Priority Data

Mar. 9, 2009 (JP) ..... 2009-054536

(51) Int. Cl.
*H01F 1/18* (2006.01)

(52) U.S. Cl. ..... 148/306; 148/300; 148/104

(58) Field of Classification Search ..... None
See application file for complete search history.

(56) References Cited

U.S. PATENT DOCUMENTS

| | | | | |
|---|---|---|---|---|
| 6,063,209 | A | 5/2000 | Matsutani et al. | |
| 6,284,060 | B1 | 9/2001 | Matsutani et al. | |
| 6,312,531 | B1 * | 11/2001 | Matsutani et al. | 148/307 |
| 2002/0097124 | A1 * | 7/2002 | Inoue et al. | 336/83 |
| 2003/0001718 | A1 | 1/2003 | Inoue et al. | |
| 2004/0052368 | A1 | 3/2004 | Inoue et al. | |
| 2004/0207954 | A1 | 10/2004 | Inoue et al. | |
| 2004/0209120 | A1 | 10/2004 | Inoue et al. | |
| 2011/0272622 | A1 * | 11/2011 | Wakabayashi et al. | 252/62.55 |

FOREIGN PATENT DOCUMENTS

| | | |
|---|---|---|
| JP | 63-113808 | 5/1988 |
| JP | 11-238613 | 8/1999 |
| JP | 11-260618 | 9/1999 |
| JP | 2002-305108 | 10/2002 |
| JP | 2005-136164 | 5/2005 |

* cited by examiner

*Primary Examiner* — John Sheehan
(74) *Attorney, Agent, or Firm* — McDermott Will & Emery LLP

(57) ABSTRACT

The invention can provide a dust core that can counteract a large electric current, achieve an increase in frequency and miniaturization, and achieve an improvement in voltage resistance, and a magnetic element using the same. The dust core of the invention is a dust core including metallic magnetic powder, an inorganic insulating material, and a thermosetting resin, in which the metallic magnetic powder has a Vickers hardness (Hv) in a range of 230≦Hv≦1000, the inorganic insulating material has a compressive strength of 10000 kg/cm$^2$ or lower and is in a mechanical collapse state, and the inorganic insulating material in a mechanical collapse state and the thermosetting resin are interposed between the metallic magnetic powder particles.

7 Claims, 2 Drawing Sheets

POWDER MAGNETIC CORE AND MAGNETIC ELEMENT USING THE SAME

RELATED APPLICATIONS

Figure 1:
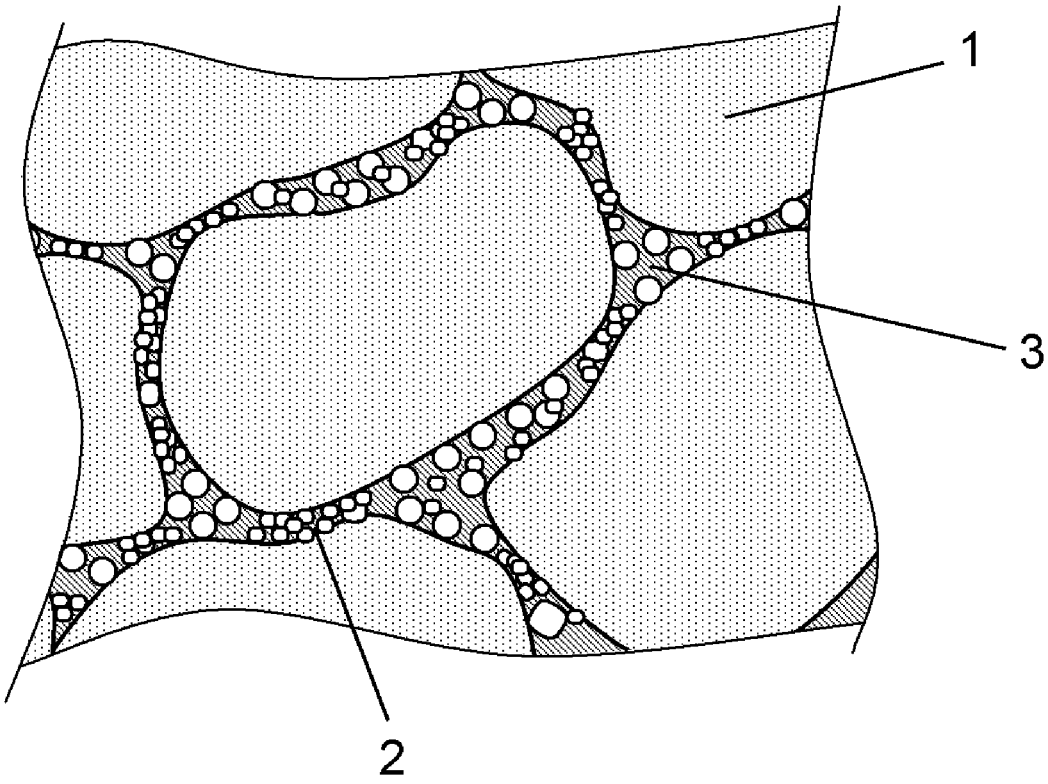

This application is the U.S. National Phase under 35 U.S.C. §371 of International Application No. PCT/JP2010/000152, filed on Jan. 14, 2010, which in turn claims the benefit of Japanese Application No. 2009-054536, filed on Mar. 9, 2009, the disclosures of which Applications are incorporated by reference herein.

TECHNICAL FIELD

The present invention relates to a dust core used for choke coils in electronic devices, such as vehicle ECUs and notebook computers, and a magnetic element using the same.

BACKGROUND ART

In accordance with the recent miniaturization and thickness reduction of electronic devices, there is strong demand for miniaturization and thickness reduction of electronic parts or devices that are used in electronic devices. On the other hand, due to an increase in speed and high integration in LSIs, such as CPUs, there are cases in which an electric current of several A to several tens of A is supplied to a power supply circuit supplied in an LSI. Therefore, there is demand for suppression of inductance degradation caused by direct current (DC) superposition as well as miniaturization and thickness reduction even in coil parts. Furthermore, there is additional demand for a low loss in a high frequency range as the operating frequency is increased. In addition, it is also desired that simple-shaped elements can be assembled by a simplified process from the viewpoint of cost reduction. That is, there is demand for supply of coil parts that can counteract a large electric current in a high frequency range and be miniaturized and reduced in thickness with lower costs.

The DC superposition characteristics are improved as the saturation magnetic flux density is increased in cores used in such coil parts. In addition, an increase in the magnetic permeability allows a high inductance value to be obtained, but degrades the DC superposition characteristics since a dust core becomes liable to be magnetically saturated. Therefore, a desirable range of the magnetic permeability is selected according to use. In addition, the magnetic loss of a core is desirably low.

An ordinary coil part in practical use is an element having a so-called EE-type or EI-type ferrite core and a coil, but the magnetic permeability of the ferrite material is high and the saturation magnetic flux density is low in this element. Therefore the inductance value is significantly degraded by magnetic saturation, and the DC superposition characteristics are deteriorated. It is possible to provide voids in the magnetic path direction of the core and use the element with lowered apparent magnetic permeability in order to improve the DC superposition characteristics, but oscillation of the core occurs in the void portions when the element is driven under an alternative current, thereby generating noise sound. In addition, since the saturation magnetic flux density of the ferrite material is still low even when the magnetic permeability is lowered, it is difficult to achieve fundamental improvement.

Therefore, Fe-based metallic magnetic materials such as a Fe—Si-based, Fe—Si—Al-based, Fe—Ni-based alloy having a higher saturation magnetic flux density than ferrite are used as a core material. However, since these metallic magnetic materials have a low electrical resistivity, when the operating frequency range is increased to several hundred kHz to several MHz as recently, the eddy-current loss is increased, and the materials cannot be used in a bulk state. Therefore, a dust core having metallic magnetic powder insulated by powdering a metallic magnetic material and a resin interposed between the metallic magnetic powder particles has been developed. Generally, such a dust core is manufactured by pressing a granular compound composed of metallic magnetic powder and a resin. A coil can be buried in a dust core by integrally molding the compound and the coil, whereby a coil-buried magnetic element can be manufactured. Since a coil-buried magnetic element is manufactured by integrally molding a coil and a compound, the manufacturing process is simple, and cost reduction can be achieved.

In addition, in comparison to an assembled magnetic element manufactured by assembling a coil and a dust core, dead spaces, such as a dimensional allowance created between the coil and the dust core in the assembled magnetic element, can be packed with the dust core in the coil-buried magnetic element, and therefore the coil-buried magnetic element can shorten the magnetic path length and extend the magnetic path cross section, and is superior in terms of the miniaturization and thickness reduction of the element.

On the other hand, since the coil and the dust core are in contact with each other in the coil-buried magnetic element, if insulation breakdown occurs in the dust core when a voltage is applied between the coil terminals, a short circuit is induced between the coil and the coil in the dust core. In addition, when a coil-buried magnetic element in which a dust core having a low electrical resistivity is used in a power supply circuit or the like, there is concern that degradation of circuit efficiency may be induced by leakage current. Therefore, there is demand for the dust core to have electrical resistivity and voltage resistance suitable for use of the coil-buried magnetic element.

Meanwhile, for example, PTL 1 and PTL 2 are known as related art documents concerning the invention of the present application. PTL 1 discloses a dust core that is composed of metallic magnetic powder, an electrically insulating material and a thermosetting resin, and has favorable magnetic properties and voltage resistance, and a method of manufacturing a coil-buried magnetic element using the same. However, the dust core in PTL 1 has an electrical resistivity (DC 50 V) that is abruptly lowered after a high-temperature heat resistance test and has a problem of reliability. The reason for the problem can include the fact that the resin gradually contracts overreactions after a thermosetting treatment due to aging variation during a high-temperature heat resistance test, and the distance between the metallic magnetic powder particles is shortened or the metallic magnetic powder particles comes into contact with each other in the dust core in PTL 1. PTL 2 discloses a dust core in which the electrical resistivity (DC 50 V) is prevented from being lowered after a high-temperature heat resistance test by using an organic binding material having a molecular weight of 200 to 8000 for an insulating film on the surface of the metallic magnetic powder particles.

However, there is demand for coils that are used in some vehicle ECU-driving circuits to have a voltage resistance of about 100 V after a high-temperature heat resistance test. Since the coil-buried magnetic elements using the dust cores in the related art do not have a voltage resistance of 100 V after the high-temperature heat resistance test, an object is to further increase the voltage resistance of dust cores.

CITATION LIST

Patent Literature

[PTL 1] Japanese Patent Unexamined Publication No. 2002-305108

[PTL 2] Japanese Patent Unexamined Publication No. 2005-136164

SUMMARY OF THE INVENTION

The dust core of the invention is a dust core including metallic magnetic powder, an inorganic insulating material, and a thermosetting resin, in which the metallic magnetic powder has a Vickers' hardness (Hv) in a range of 230≦Hv≦1000, the inorganic insulating material has a compressive strength of 10000 kg/cm$^2$ or lower and is in a mechanical collapse state, and the inorganic insulating material in a mechanical collapse state and the thermosetting resin are interposed between the metallic magnetic powder particles.

Furthermore, the magnetic element of the invention is configured to have a coil buried in the dust core of the invention.

The above configuration allows counteraction of a large electric current, achieves an increase in frequency and miniaturization, and also achieves improvement in voltage resistance.

DESCRIPTION OF EMBODIMENTS

First Exemplary Embodiment

The dust core according to a first exemplary embodiment of the invention and a magnetic element using the same will be described.

The dust core according to the first exemplary embodiment of the invention is a dust core including metallic magnetic powder, an inorganic insulating material, and a thermosetting resin. The metallic magnetic powder has a Vickers hardness (Hv) in a range of 230≦Hv≦1000. The inorganic insulating material has a compressive strength of 10000 kg/cm$^2$ or lower. The dust core of the exemplary embodiment is configured to have the inorganic insulating material and the thermosetting resin interposed between the metallic magnetic powder particles.

This configuration makes the magnetic properties, electrical resistivity and voltage resistance of the dust core favorable.

The reason for the favorable magnetic properties is that adjustment of the Vickers hardness of the metallic magnetic powder and the compressive strength of the inorganic insulating material to the above ranges accelerates the mechanical collapse of the inorganic insulating material during pressing of the dust core, thereby improving the packing factor of the dust core.

The reason for the favorable electrical resistivity and the voltage resistance is that interposition of the inorganic insulating material between the metallic magnetic powder particles prevents the contact between the metallic magnetic powder particles. In addition, the above configuration prevents the metallic magnetic powder particles from coming into contact with each other even when the resin gradually contracts over reactions after the thermosetting treatment so that the electrical resistivity and the voltage resistance are favorable even after the high-temperature heat resistance test.

Specifically, it is desirable that the metallic magnetic powder particles used for the exemplary embodiment be substantially spherical. This is because magnetic circuits are limited when flat metallic magnetic powder particles are used since magnetic anisotropy is induced in the dust core.

The metallic magnetic powder used for the first exemplary embodiment desirably has a Vickers hardness (Hv) in a range of 230≦Hv≦1000. When the Vickers hardness is smaller than 230 Hv, since the mechanical collapse of the inorganic insulating material does not occur sufficiently during pressing of the dust core, and a high packing factor cannot be obtained, favorable DC superposition characteristics and a low magnetic loss cannot be obtained. On the other hand, when the Vickers hardness is larger than 1000 Hv, the plastic deformability of the metallic magnetic powder is significantly degraded such that a high packing factor cannot be obtained, which is not preferable. The mechanical collapse mentioned herein refers to a state in which the insulating material is compressed by the metallic magnetic powder so as to be crushed and made fine during pressing of the dust core so that the insulating material is interposed between the metallic magnetic powder particles.

FIG. 1 shows an enlarged view of the dust core according to the exemplary embodiment. Inorganic insulating material 2 is present between the particles of metallic magnetic powder 1 in a mechanical collapse state. In addition, thermosetting resin 3 is present so as to fill the voids.

In addition, the metallic magnetic powder used for the first exemplary embodiment desirably includes at least one kind of Fe—Ni-based, Fe—Si—Al-based, Fe—Si-based, Fe—Si—Cr-based, and other Fe-based metallic magnetic powder. Since the metallic magnetic powder including Fe as the main component has a high saturation magnetic flux density, the metallic magnetic powder is useful for use at a large electric current.

When a Fe—Ni-based metallic magnetic powder is used, the desirable ratio is 40% by weight to 90% by weight of the content of Ni and the balance composed of Fe and inevitable impurities. Here, examples of the inevitable impurities include Mn, Cr, Ni, P, S, C and the like. When the content of Ni is smaller than 40% by weight, the effect of improving the soft magnetic properties is not sufficient, and when the content is larger than 90% by weight, the saturation magnetization is significantly degraded, and the DC superposition characteristics are degraded. Furthermore, 1% by weight to 6% by weight of Mo may be included to improve the DC superposition characteristics.

When a Fe—Si—Al-based metallic magnetic powder is used, the desirable ratio is 8% by weight to 12% by weight of Si, 4% by weight to 6% by weight of the content of Al, and the balance composed of Fe and inevitable impurities. Here, examples of the inevitable impurities include Mn, Cr, Ni, P, S, C and the like. Adjustment of the content of each of the constituent elements in the above range can produce high DC superposition characteristics and a low coercive force.

When a Fe—Si-based metallic magnetic powder is used, the desirable ratio is 1% by weight to 8% by weight of the content of Si and the balance composed of Fe and inevitable impurities. Here, examples of the inevitable impurities include Mn, Cr, Ni, P, S, C and the like. Inclusion of Si has an effect of decreasing magnetic anisotropy and the magnetostriction constant, and increasing electrical resistance, thereby reducing the eddy-current loss. When the content of Si is smaller than 1% by weight, the effect of improving the soft magnetic properties is not sufficient, and when the content is larger than 8% by weight, the saturation magnetization is significantly degraded, and the DC superposition characteristics are degraded.

When a Fe—Si—Cr-based metallic magnetic powder is used, the desirable ratio is 1% by weight to 8% by weight of Si, 2% by weight to 8% by weight of the content of Cr, and the balance composed of Fe and inevitable impurities. Here, examples of the inevitable impurities include Mn, Cr, Ni, P, S, C and the like.

Inclusion of Si has an effect of decreasing magnetic anisotropy and the magnetostriction constant, and increasing electrical resistance, thereby reducing the eddy-current loss. When the content of Si is smaller than 1% by weight, the effect of improving the soft magnetic properties is not sufficient, and when the content is larger than 8% by weight, the saturation magnetization is significantly degraded, and the DC superposition characteristics are degraded. In addition, inclusion of Cr has an effect of improving weather resistance. When the content of Cr is smaller than 2% by weight, the effect of improving the weather resistance is not sufficient, and when the content is larger than 8% by weight, degradation of the soft magnetization characteristics occurs, which is not preferable.

When a Fe-based metallic magnetic powder is used, the metallic magnetic powder is desirably composed of the main component of Fe and inevitable impurities. Here, examples of the inevitable impurities include Mn, Cr, Ni, P, S, C and the like. An increase in the purity of Fe produces a high saturation magnetic flux density.

The same effect as with the above components can be obtained by using an amorphous alloy or a nanocrystal soft magnetic alloy as well as the above crystalline metallic magnetic powder.

The same effect can be obtained even when at least two kinds of the metallic magnetic powder including Fe as the main component are included.

Addition of a small amount of a Fe—Ni-based metallic magnetic powder having a high plastic deformability to a metallic magnetic powder having a low plastic deformability, such as a Fe—Si—Al-based metallic magnetic powder, can further increase the packing factor.

In addition, the average particle diameter of the metallic magnetic powder used in the first exemplary embodiment is desirably 1 μm to 100 μm. When the average particle diameter is smaller than 1.0 μm, a high packing factor cannot be obtained, and therefore the magnetic permeability is degraded, which is not preferable. In addition, when the average particle diameter becomes larger than 100 μm, the eddy-current loss becomes large in a high frequency range, which is not preferable. A more preferable range is 1 μm to 50 μm.

In addition, the inorganic insulating material used for the first exemplary embodiment desirably has a compressive strength of 10000 kg/cm$^2$ or lower. When the compressive strength is larger than 10000 kg/cm$^2$, the mechanical collapse of the inorganic insulating material is not sufficient during molding of the dust core, and the packing factor of the metallic magnetic powder is degraded such that excellent DC superposition characteristics and a low magnetic loss cannot be obtained.

Meanwhile, examples of the inorganic insulating material having a compressive strength of 10000 kg/cm$^2$ or lower include materials, such as h-BN, MgO, mullite ($3Al_2O_3.2SiO_2$), steatite ($MgO.SiO_2$), forsterite ($2MgO.SiO_2$), cordierite ($2MgO.2Al_2O_3.5SiO_2$), zircon ($ZrO_2.SiO_2$), and the like. However, there is no particular problem with inorganic insulating materials other than the inorganic insulating materials as described above as long as the inorganic insulating materials have a compressive strength of 10000 kg/cm$^2$ or lower.

In addition, the amount of the inorganic insulating material mixed in the first exemplary embodiment is desirably set to 1% by volume to 15% by volume when the volume of the metallic magnetic powder is set to 100% by volume. When the mixed amount of the inorganic insulating material is smaller than 1%, the electrical resistivity and voltage resistance of the dust core are degraded, which is not preferable. In addition, when the mixed amount of the inorganic insulating material is larger than 15%, the fraction of the dust core occupied by non-magnetic portions is increased, and the magnetic permeability is degraded, which is not preferable.

In addition, examples of the thermosetting resin used in the first exemplary embodiment include epoxy resins, phenol resins, butyral resins, vinyl chloride resins, polyimide resins, silicone resins, and the like. Use of a dust core to which a thermosetting resin is added in manufacturing a coil-buried magnetic element can prevent cracking in the dust core when integrally molded with a coil and obtain favorable moldability. In addition, a thermosetting treatment on an integrally molded coil-buried magnetic element can improve product strength and provide magnetic elements that are excellent in terms of productivity. A dispersant may be added to the metallic magnetic powder in order to improve the dispersibility of the thermosetting resin in the metallic magnetic powder.

In addition, the dust core according to the first exemplary embodiment desirably has a packing factor of the metallic magnetic powder of 65% to 82% by volume conversion. This configuration can produce a dust core having favorable magnetic properties, electrical resistivity, voltage resistance, and compact strength. When the packing factor of the metallic magnetic powder is smaller than 65%, the magnetic properties are degraded, which is not preferable. In addition, when the packing factor of the metallic magnetic powder is larger than 82%, the compact strength is degraded, which is not preferable.

In addition, the dust core according to the first exemplary embodiment desirably has an electrical resistivity of $10^5$ Ω·cm or higher. This configuration can suppress leakage current and prevent degradation of circuit efficiency. When the electrical resistivity is less than $10^5$ Ω·cm, there is a concern that the leakage current may be increased when a coil-buried magnetic element (vertical 6 mm×horizontal 6 mm) in which the dust core is used is mounted in a DC/DC converter circuit, and degradation of circuit efficiency may be induced.

Figure 2:
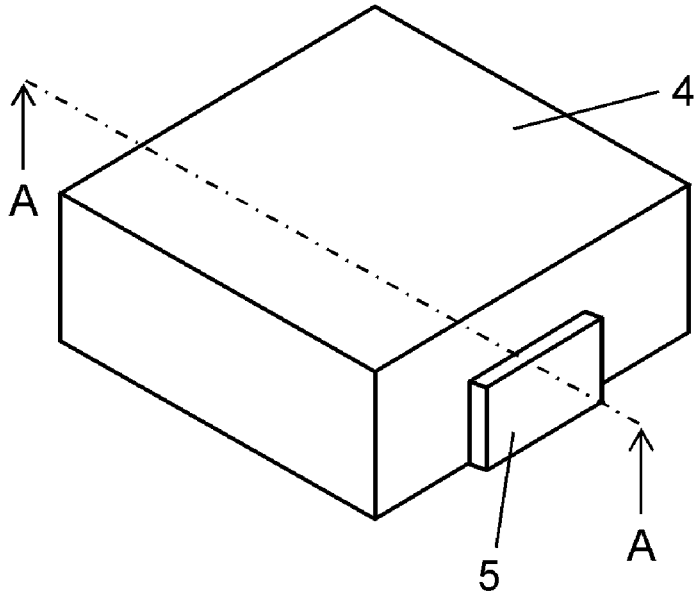
Figure 3:
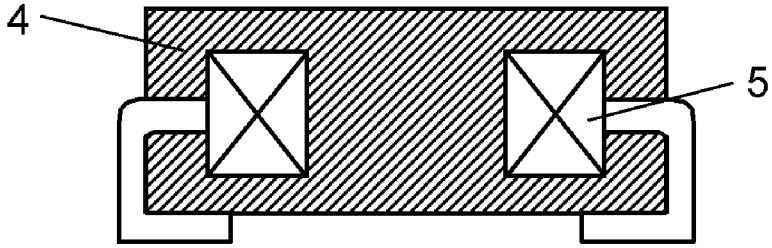

Meanwhile, the magnetic element according to the first exemplary embodiment is configured to have a coil buried in the dust core. FIG. 2 shows an overall schematic view of the magnetic element according to the exemplary embodiment. FIG. 3 shows an A-A cross-sectional view of the magnetic element according to the exemplary embodiment. The magnetic element according to the exemplary embodiment is a coil-buried magnetic element as shown in FIGS. 2 and 3 and is composed of dust core 4 and coil portion 5.

The above configuration allows the manufacture of a coil-buried magnetic element.

The configuration as described above can produce dust cores having favorable magnetic properties, electrical resistivity, and voltage resistance even in a large current and high frequency range. In addition, burial of a coil in the dust core can provide dust cores having high voltage resistance as well after a high-temperature heat resistance test with the miniaturization and thickness reduction of the coil-buried magnetic element maintained.

Hereinafter, a method of manufacturing the dust core according to the first exemplary embodiment of the invention will be described.

The method of manufacturing the dust core according to the first exemplary embodiment includes a step in which the Vickers hardness (Hv) of the metallic magnetic powder is increased to a range of $230 \leqq Hv \leqq 1000$, a step in which an inorganic insulating material having a compressive strength of 10000 kg/cm$^2$ or lower is dispersed in the metallic magnetic powder, thereby manufacturing a complex magnetic material, a step in which the complex magnetic material and a thermosetting resin are mixed and dispersed, thereby manufacturing a compound, and a step in which the compound is pressed, thereby forming a compact.

The step of increasing the hardness of the metallic magnetic powder accelerates the mechanical collapse of the inorganic insulating material during pressing of a compound, whereby the packing factor of the dust core can be increased.

In addition, the step of dispersing the inorganic insulating material between the particles of metallic magnetic powder whose hardness has been increased interposes the inorganic insulating material between the metallic magnetic powder particle and the metallic magnetic powder particle, whereby a complex magnetic material in which the contact of the metallic magnetic powder particles is suppressed can be manufactured. Therefore, the electrical resistivity and voltage resistance of the dust core can be improved.

In addition, the step of mixing and dispersing the complex magnetic material and a thermosetting resin so as to manufacture a compound can manufacture a compound in which the inorganic insulating material and the thermosetting resin are interposed between the metallic magnetic powder particles. Therefore, the packing factor, electrical resistivity, and voltage resistance of the dust core and the compact strength can be improved.

In addition, the step of pressing the compound so as to form a compact can produce a dust core. Meanwhile, integral molding of the compound and a coil can manufacture a coil-buried magnetic element.

In addition, after the step of forming the compact, the strength can be further improved by carrying out a thermosetting treatment step on the manufactured dust core. Meanwhile, the strength of a magnetic element can be improved by similarly carrying out a thermosetting treatment step on the coil-buried magnetic element manufactured by integral molding of the compound and the coil.

Such a manufacturing method improves the metal packing factor of the dust core and also improves the electrical resistivity and voltage resistance, whereby the strength of the dust core can be secured. As a result, the coil-buried magnetic element in which the dust core is used can counteract a large electric current, achieve an increase in frequency and miniaturization, and achieve an increase in voltage resistance while the electrical resistivity is maintained.

Examples of an apparatus used in the step of increasing the hardness of the metallic magnetic powder according to the first exemplary embodiment include a ball mill. Meanwhile, other than a ball mill, the apparatus is not particularly specified as long as the apparatus is a mechanical alloy apparatus that supplies a strong compressive shear force to the metallic magnetic powder, thereby introducing processing strain, such as a MECHANO-FUSION SYSTEM, manufactured by Hosokawa Micron Corporation.

Examples of an apparatus used in the step of dispersing the inorganic insulating material between the hardness-improved metallic magnetic powder particles and thereby manufacturing a complex magnetic material according to the first exemplary embodiment include a ball mill. Meanwhile, the same effect can be expected with an apparatus other than a ball mill, for example, a V-shaped mixer and a cross rotary.

Meanwhile, the method of mixing and dispersing the complex magnetic material and the thermosetting resin according to the first exemplary embodiment is not particularly limited.

Meanwhile, the pressing method in the first exemplary embodiment is not particularly limited, and includes an ordinary pressing method in which a uniaxial molder is used.

Meanwhile, when a step of thermosetting treatment on the dust core is carried out after the step of forming a compact according to the first exemplary embodiment, methods of the thermosetting treatment are not particularly limited, and are carried out using an ordinary drying furnace. The thermosetting treatment is carried out at the hardening temperature of the thermosetting resin.

Hereinafter, cases in which dust cores are manufactured using a variety of metallic magnetic powders will be described.

Metallic magnetic powder having an average particle diameter of 8 μm, shown in Table 1A and Table 1B, is prepared. The hardness of the metallic magnetic powder is increased by treating the metallic magnetic powder using a tumbling ball mill (hereinafter, this step will be referred to as the 'hardness-improving process'). The hardness of the metallic magnetic powder is measured using a micro surface material characteristics evaluation system (manufactured by Mitsutoyo Corporation). In addition, 5.5% by volume of an inorganic insulating material having an average particle diameter of 1.5 μm, shown in Table 1A and Table 1B, is mixed with 100% by volume of the hardness-improved metallic magnetic powder, and the metallic magnetic powder and the inorganic insulating material are dispersed using a planetary ball mill, thereby manufacturing a complex magnetic material. Meanwhile, the compressive strength of the inorganic insulating material in Table 1A and Table 1B is a result measured using a micro compression tester. In addition, a compound having 10% by volume of an epoxy resin as the thermosetting resin mixed with 100% by volume of the complex magnetic material is manufactured. The obtained compound is pressed with the molding pressures as described in Table 1A and Table 1B at room temperature, thereby manufacturing a compact. After that, a thermosetting treatment is carried out for 2 hours at 150° C., and a dust core for magnetic properties evaluation and a specimen for voltage resistance evaluation are manufactured. Meanwhile, the shape of the manufactured dust core is a toroidal shape having approximately an outer diameter of 15 mm, an inner diameter of 10 mm, and a height of 3 mm. In addition, the shape of the manufactured specimen is a disc shape having approximately a diameter of 10 mm and a height of 1 mm.

In addition, compounds to which no inorganic insulating material is added are manufactured as comparative examples, and dust cores and specimens are manufactured by the same method.

After a thermal treatment corresponding to a test of heat resistant reliability (150° C.-2000 hours) that is required as a coil part is carried out on the specimen which has undergone the thermosetting treatment, In—Ga electrodes are applied and formed on the top and bottom surfaces, electrodes are placed on those In—Ga electrodes, and the electrical resistivity between the top and bottom surfaces of the specimen is measured at a voltage of 100 V.

Magnetic permeability when direct currents are superposed and flowed through the obtained dust core (hereinafter referred to as the 'direct current superposition characteristics') and magnetic loss, which is one of the magnetic properties of the dust core, are evaluated. With regard to the direct current superposition characteristics, an inductance value at an applied magnetic field of 55 Oe, a frequency of 1 MkHz, and a turn number of 20 is measured using an LCR meter (manufactured by HP company; 4294A), and a magnetic permeability is computed from the obtained inductance value and the shape of the dust core. With regard to the magnetic loss, measurement is carried out at a measurement frequency of 1 MHz, and a measurement magnetic flux density of 25 mT using an alternative current B—H curve analyzer (manufactured by Iwatsu Test Instruments Corporation; SY-8258). Cases in which the DC superposition characteristics, magnetic loss, and voltage resistance characteristics are favorable correspond to the present exemplary embodiment. The obtained evaluation results are shown in Table 1A and Table 1B.

| No | Metallic magnetic powder Composition | Metallic magnetic powder Hardness (Hv) | Hardness-improving process | Insulating material | Compressive strength (kg/cm$^2$) | Molding pressure (ton/cm$^2$) | Packing factor (%) | Permeability (550e) | Magnetic loss (kW/m$^3$) | Electrical resistivity of the test of reliability (Ω · cm) | |
|---|---|---|---|---|---|---|---|---|---|---|---|
| 1 | Fe-1.5Si | 150 | No | h-BN | 540 | 3 | 63.9 | 12 | 3010 | 1.E+08 | Comparative Example |
| 2 | | 215 | Yes | h-BN | 540 | | 64.5 | 14 | 2950 | 1.E+08 | Comparative Example |
| 3 | | 235 | Yes | h-BN | 540 | | 65.3 | 16 | 2870 | 1.E+08 | Example |
| 4 | | 365 | Yes | h-BN | 540 | | 67.4 | 18 | 2690 | 1.E+08 | Example |
| 5 | | 520 | Yes | h-BN | 540 | | 70.1 | 21 | 2550 | 1.E+08 | Example |
| 6 | | 520 | Yes | $Al_2O_3$ | 37000 | | 62.9 | 12 | 3100 | <1.E+3 | Comparative Example |
| 7 | Fe-5.9Si | 415 | No | MgO | 8400 | 3.5 | 66.6 | 16 | 2320 | 1.E+09 | Example |
| 8 | | 740 | Yes | MgO | 8400 | | 70.7 | 21 | 1950 | 1.E+09 | Example |
| 9 | | 1000 | Yes | MgO | 8400 | | 65.2 | 15 | 2390 | 1.E+09 | Example |
| 10 | | 1000 | Yes | BeO | 15000 | | 60.5 | 11 | 2730 | <1.E+3 | Comparative Example |
| 11 | | 1150 | Yes | MgO | 8400 | | 59.9 | 10 | 2820 | 1.E+09 | Comparative Example |
| 12 | Fe-5.5Si-2.5Cr | 380 | No | Forsterite | 5900 | 3.7 | 66.3 | 17 | 2230 | 1.E+09 | Example |
| 13 | | 510 | Yes | Forsterite | 5900 | | 68.1 | 19 | 2010 | 1.E+09 | Example |
| 14 | | 750 | Yes | Forsterite | 5900 | | 70.3 | 21 | 1820 | 1.E+09 | Example |
| 15 | | 750 | Yes | $Si_3N_4$ | 35000 | | 60.4 | 11 | 2540 | <1.E+3 | Comparative Example |
| 16 | Fe78Ni | 162 | No | Cordierite | 3500 | 3 | 63.4 | 12 | 1620 | 1.E+10 | Comparative Example |
| 17 | | 230 | Yes | Cordierite | 3500 | | 65 | 16 | 1500 | 1.E+10 | Example |
| 18 | | 350 | Yes | Cordierite | 3500 | | 68.2 | 19 | 1420 | 1.E+10 | Example |
| 19 | | 525 | Yes | Cordierite | 3500 | | 71.1 | 22 | 1350 | 1.E+10 | Example |
| 20 | | 525 | Yes | $Al_2O_3$ | 37000 | | 63 | 12 | 1600 | <1.E+3 | Comparative Example |

TABLE 1B

| No | Metallic magnetic powder Composition | Metallic magnetic powder Hardness (Hv) | Hardness-improving process | Insulating material | Compressive strength (kg/cm$^2$) | Molding pressure (ton/cm$^2$) | Packing factor (%) | Permeability (550e) | Magnetic loss (kW/m$^3$) | Electrical resistivity of the test of reliability (Ω · cm) | |
|---|---|---|---|---|---|---|---|---|---|---|---|
| 21 | Fe50Ni | 175 | No | Mullite | 7100 | 3.3 | 63.3 | 12 | 2100 | 1.E+10 | Comparative example |
| 22 | | 238 | Yes | Mullite | 7100 | | 65.1 | 16 | 1820 | 1.E+10 | Example |
| 23 | | 355 | Yes | Mullite | 7100 | | 68.3 | 20 | 1700 | 1.E+10 | Example |
| 24 | | 515 | Yes | Mullite | 7100 | | 70.9 | 22 | 1620 | 1.E+10 | Example |
| 25 | | 515 | Yes | BeO | 15000 | | 62.8 | 12 | 2110 | <1.E+3 | Comparative example |
| 26 | Fe-10.2Si-4.5Al | 500 | No | Steatite | 5600 | 4 | 66.3 | 16 | 1630 | 1.E+09 | Example |
| 27 | | 750 | Yes | Steatite | 5600 | | 70.3 | 21 | 1500 | 1.E+09 | Example |
| 28 | | 1000 | Yes | Steatite | 5600 | | 65 | 15 | 1690 | 1.E+09 | Example |
| 29 | | 1000 | Yes | $Si_3N_4$ | 35000 | | 60.1 | 11 | 2050 | <1.E+3 | Comparative example |
| 30 | | 1150 | Yes | Steatite | 5600 | | 59.3 | 10 | 2060 | 1.E+09 | Comparative example |
| 31 | Fe | 125 | No | Zircon | 6300 | 2.5 | 64.2 | 12 | 4510 | 1.E+07 | Example |
| 32 | | 235 | Yes | Zircon | 6300 | | 66 | 16 | 4360 | 1.E+07 | Example |
| 33 | | 340 | Yes | Zircon | 6300 | | 68.2 | 20 | 4020 | 1.E+07 | Example |
| 34 | | 490 | Yes | Zircon | 6300 | | 72.5 | 23 | 3800 | 1.E+07 | Example |
| 35 | | 490 | Yes | $Al_2O_3$ | 37000 | | 63.4 | 12 | 4430 | <1.E+3 | Comparative example |

Nos. 1 to 11 show the evaluation results when Fe—Si-based metallic magnetic powder is used. Meanwhile, the Vickers hardness of the Fe-1.5Si and the Fe-5.9Si powder, for which the hardness-improving process is not carried out, is 150 Hv, and 415 Hv, respectively.

Nos. 1 to 6 show the results of the Fe-1.5Si. No. 1 shows that the packing factor is low, and favorable direct current superposition characteristics and magnetic loss cannot be obtained when the hardness-improving process is not carried out. The cause of the low packing factor is considered to be that the hardness of the metallic magnetic powder is low, and therefore the mechanical collapse of the inorganic insulating material was not sufficient during the pressing.

Nos. 2 to 6 show that the hardness of the metallic magnetic powder is increased when the hardness-improving process is carried out. Nos. 3 to 5 show that, when h-BN in which the Vickers hardness (Hv) of the metallic magnetic powder is 235≦Hv≦520, and the compressive strength of the inorganic insulating material is 540 kg/cm$^2$ is used, the packing factor is improved by the mechanical collapse of the inorganic insulating material during the pressing, and the inorganic insulating material is interposed between the metallic magnetic powder particles. Therefore, it is possible to obtain a highly voltage resistant dust core having favorable direct current superposition characteristics, magnetic loss, and electrical resistivity.

On the other hand, Nos. 2 and 6 show that, when the Vickers hardness of the metallic magnetic powder is less than 230≦Hv, or the compressive strength of the inorganic insulating material is larger than 10000 kg/cm$^2$, the mechanical collapse of the inorganic insulating material does not occur sufficiently during the pressing, and favorable direct current superposition characteristics and magnetic loss cannot be obtained.

Nos. 7 to 11 show the results of the Fe-5.9Si. No. 7 shows that the Vickers hardness of the metallic magnetic powder is 415 Hv even when the hardness is not improved by the hardness-improving process. Therefore, when MgO having a compressive strength of the inorganic insulating material of 8400 kg/cm$^2$ is used, the packing factor is improved by the mechanical collapse of the inorganic insulating material during the pressing, and the inorganic insulating material is interposed between the metallic magnetic powder particles. Therefore, it is possible to obtain a highly voltage resistant dust core having favorable direct current superposition characteristics, magnetic loss, and electrical resistivity.

Nos. 8 and 9 show that, when MgO is used, which has undergone the hardness-improving process of the metallic magnetic powder, has a Vickers hardness of 740 Hv to 1000 Hv and a compressive strength of the inorganic insulating material of 8400 kg/cm$^2$, the packing factor is improved by the mechanical collapse of the inorganic insulating material during the pressing, and the inorganic insulating material is interposed between the metallic magnetic powder particles. Therefore, it is possible to obtain a highly voltage resistant dust core having favorable direct current superposition characteristics, magnetic loss, and electrical resistivity. In addition, No. 8 shows that, particularly, an increase in the Vickers hardness to 740 Hv can produce even higher direct current superposition characteristics and even lower magnetic loss.

On the other hand, No. 10 shows that, when the compressive strength of the inorganic insulating material is larger than 10000 kg/cm$^2$, the mechanical collapse of the inorganic insulating material does not occur sufficiently during the pressing, and favorable direct current superposition characteristics and magnetic loss cannot be obtained.

In addition, No. 11 shows that, when the Vickers hardness of the metallic magnetic powder is larger than 1000 Hv, the plastic deformability of the metallic magnetic powder is significantly degraded such that a high packing factor cannot be obtained, and therefore the soft magnetic properties are degraded, which is not preferable.

Nos. 12 to 15 show the evaluation results of the Fe—Si—Cr-based metallic magnetic powder, Nos. 16 to 25 show the evaluation results of the Fe—Ni-based metallic magnetic powder, Nos. 26 to 30 show the evaluation results of the Fe—Si—Al-based metallic magnetic powder, and Nos. 31 to 35 show the evaluation results of the Fe-based metallic magnetic powder. Similarly to the evaluation results of the Fe—Si-based powder, the packing factor is improved by the mechanical collapse of the inorganic insulating material during the pressing, and the inorganic insulating material is interposed between the metallic magnetic powder when the Vickers hardness (Hv) of a variety of metallic magnetic powder is 230≦Hv≦1000, and the compressive strength of the inorganic insulating material is 10000 kg/cm$^2$ or lower. Therefore, it is possible to obtain a highly voltage resistant dust core having favorable direct current superposition characteristics, magnetic loss, and electrical resistivity.

In addition, higher direct current superposition characteristics and lower magnetic loss can be obtained by increasing the Vickers hardness to the vicinity of 750 Hv for the Fe—Si—Cr-based and Fe—Si—Al-based metallic magnetic powder.

Table 1 shows that the Vickers hardness (Hv) of the metallic magnetic powder is desirably 230≦Hv to 1000 Hv, and the same effect can be obtained when the hardness is increased by undergoing the hardness-improving process so as to reach a predetermined value. When the Vickers hardness (Hv) of the metallic magnetic powder is smaller than 230≦Hv, the mechanical collapse of the inorganic insulating material does not occur sufficiently, and a dust core having favorable direct current superposition characteristics, magnetic loss, and electrical resistivity cannot be obtained. On the other hand, when the Vickers hardness (Hv) of the metallic magnetic powder is larger than 1000 Hv, the plastic deformability of the metallic magnetic powder is significantly degraded such that a high packing factor cannot be obtained, and therefore the soft magnetic properties are degraded, which is not preferable.

In addition, the packing factor of the metallic magnetic powder in the dust core is desirably 65% or higher by volume conversion. Excellent direct current superposition characteristics and low magnetic loss are exhibited when the packing factor is adjusted to 65% or higher.

The compressive strength of the inorganic insulating material is desirably 10000 kg/cm$^2$ or lower. When the compressive strength is larger than 10000 kg/cm$^2$, the mechanical collapse of the inorganic insulating material does not occur sufficiently during the pressing, and therefore, the packing factor of the metallic magnetic powder is lowered, and a dust core having favorable direct current superposition characteristics and magnetic loss cannot be obtained.

Meanwhile, it is desirable to include at least one kind of inorganic substance, such as h-BN, MgO, mullite ($3Al_2O_3.2SiO_2$), steatite ($MgO.SiO_2$), forsterite ($2MgO.SiO_2$), cordierite ($2MgO.2Al_2O_3.5SiO_2$), zircon ($ZrO_2.SiO_2$), and the like as the inorganic insulating material having a compressive strength of 10000 kg/cm$^2$.

Meanwhile, there is no problem with use of any inorganic insulating materials other than the inorganic insulating materials described in the table as long as the compressive strength is 10000 kg/cm$^2$ or lower.

Second Exemplary Embodiment

Hereinafter, the amount of the inorganic insulating material mixed in a second exemplary embodiment of the invention will be described.

Meanwhile, the same configuration as the first exemplary embodiment will not be described, and differences will be described in detail.

Fe—Si-based metallic magnetic powder, for which the composition of the Fe—Si-based metallic magnetic powder is Fe-3.5Si by % by weight and the average particle diameter is 10 μm, is used. The hardness of the metallic magnetic powder is increased by treating the Fe-3.5Si metallic magnetic powder using a planetary ball mill, thereby manufacturing metallic magnetic powder having a Vickers hardness of 355 Hv. Mullite ($3Al_2O_3.2SiO_2$) having an average particle diameter of 3.5 μm and a compressive strength of 7100 kg/cm$^2$ is mixed with 100% by volume of the metallic magnetic powder having an increased hardness as the inorganic insulating material according to the description in Table 2, and the inorganic insulating material is dispersed on the surface of the metallic magnetic powder particles using a tumbling ball mill, thereby manufacturing a complex magnetic powder. In addition, 8% by volume of a phenol resin is mixed with 100% by volume of the complex magnetic powder as the thermosetting resin, thereby manufacturing a compound. The obtained compound is pressed with a molding pressure of 5 ton/cm$^2$ so as to manufacture a compact. After that, the compact is subjected to a thermosetting treatment at 150° C. for 2 hours so as to manufacture a dust core for magnetic properties evaluation and a specimen for voltage resistance evaluation.

Meanwhile, the method of evaluating the hardness of the metallic magnetic powder, the compressive strength of the inorganic insulating material, the shape of the obtained dust core, the shape of the specimen, the direct current superposition characteristics, the magnetic loss, and the electrical resistivity is carried out under the same conditions as described above. The obtained evaluation results are shown in Table 2.

| No | Amount of the inorganic insulating material (vol %) | Packing factor (%) | Permeability (550e) | Magnetic loss (kW/m$^3$) | Electrical resistivity of the test of reliability (Ω · cm) | |
|---|---|---|---|---|---|---|
| 36 | 0 | 77.9 | 36 | 1910 | 1.E+3 | Comparative example |
| 37 | 0.5 | 77 | 34 | 1520 | 1.E+04 | Comparative example |
| 38 | 1 | 75.7 | 28 | 1600 | 1.E+05 | Example |
| 39 | 5 | 72.1 | 24 | 1820 | 1.E+07 | Example |
| 40 | 10 | 69.3 | 20 | 2070 | 1.E+08 | Example |
| 41 | 15 | 66.1 | 15 | 2200 | 1.E+08 | Example |
| 42 | 20 | 62.9 | 11 | 2510 | 1.E+08 | Comparative example |

Nos. 36 to 42 show that dust cores having favorable direct current superposition characteristics, magnetic loss, and electrical resistivity can be realized with the mixed amount of the inorganic insulating material of 1.0% by volume to 15% by volume.

When the mixed amount of the inorganic insulating material is smaller than 1.0% by volume, degradation of the electrical resistivity and magnetic loss occurs, which is not preferable. In addition, when the mixed amount of the inorganic insulating material is larger than 15% by volume, the packing factor of the Fe—Si-based metallic magnetic powder in the compact is lowered, and the direct current superposition characteristics are degraded, which is not preferable.

Third Exemplary Embodiment

Hereinafter, the packing factor of the metallic magnetic powder occupying the dust core in a third exemplary embodiment of the invention will be described.

Meanwhile, the same configuration as the first exemplary embodiment will not be described, and differences will be described in detail.

Fe—Si—Cr-based metallic magnetic powder, for which the average particle diameter is 25 μm and the alloy composition is Fe-4.7Si-3.8Cr by % by weight, is used. The hardness of the metallic magnetic powder is increased by treating the Fe-4.7Si-3.8Cr metallic magnetic powder using a tumbling ball mill, thereby manufacturing metallic magnetic powder having a Vickers hardness of 400 Hv. 3.5% by volume of MgO having an average particle diameter of 2 μm and a compressive strength of 8400 kg/cm$^2$ is weighed and mixed with 100% by volume of the metallic magnetic powder as the inorganic insulating material. After that, the inorganic insulating material is dispersed on the surface of the metallic magnetic powder particles using a V-shaped mixer, thereby manufacturing a complex magnetic powder. A silicone resin is mixed with the complex magnetic powder as the thermosetting resin according to the ratio shown in Table 3, thereby manufacturing a compound. The compound is pressed with a molding pressure of 4.5 ton/cm$^2$ so as to manufacture a compact. The compact is subjected to a thermosetting treatment at 150° C. for 2 hours so as to manufacture a dust core for magnetic properties evaluation and a specimen for voltage resistance evaluation.

Meanwhile, the method of evaluating the hardness of the metallic magnetic powder, the compressive strength of the inorganic insulating material, the shape of the obtained dust core, the shape of the specimen, the direct current superposition characteristics, the magnetic loss, and the electrical resistivity is carried out under the same conditions as described above. The moldability of each sample is evaluated by the presence and absence of cracking. The obtained evaluation results are shown in Table 3.

| No | Packing factor (%) | Amount of the resin (vol %) | Permeability (550e) | Magnetic loss (kW/m$^3$) | Electrical resistivity of the test of reliability (Ω · cm) | Strength of the compact | |
|---|---|---|---|---|---|---|---|
| 43 | 60 | 10 | 12 | 2680 | 1.E+09 | ○ | Comparative example |
| 44 | 60 | 30 | 11 | 2680 | 1.E+09 | ○ | Comparative example |
| 45 | 65 | 25 | 16 | 2300 | 1.E+09 | ○ | Example |
| 46 | 70 | 20 | 20 | 2150 | 1.E+09 | ○ | Example |
| 47 | 75 | 15 | 28 | 1830 | 1.E+09 | ○ | Example |
| 48 | 80 | 10 | 36 | 1510 | 1.E+09 | ○ | Example |
| 49 | 82 | 8 | 38 | 1320 | 1.E+08 | ○ | Example |
| 50 | 85 | 5 | 41 | 1050 | 1.E+07 | x | Comparative example |

Table 3 shows that, when MgO having a compressive strength of 8400 kg/cm$^2$ is used as the inorganic insulating material, highly voltage resistant dust cores that are favorable in terms of all of direct current superposition characteristics, magnetic loss, and electrical resistivity can be obtained in Nos. 45 to 49 having the packing factor of the metallic magnetic powder of 65% to 82% by volume conversion. On the other hand, in the cases of Nos. 43 and 44 having the packing factor of the metallic magnetic powder of less than 65%, the direct current superposition characteristics are extremely degraded regardless of the amount of the resin, and the magnetic loss is also increased, which are not preferable. In addition, in No. 50 having the packing factor of 85%, the direct current superposition characteristics, magnetic properties, and electrical resistivity are favorable, but fine cracks occur such that it is difficult to use the dust core for actual mass production due to the degradation in the strength of the compact.

Fourth Exemplary Embodiment

Hereinafter, the average particle diameter of the metallic magnetic powder in a fourth exemplary embodiment of the invention will be described.

Meanwhile, the same configuration as the first exemplary embodiment will not be described, and differences will be described in detail.

Fe metallic magnetic powder having the average particle diameter shown in Table 4 is used, and the hardness of the metallic magnetic powder is increased with a treatment using a planetary ball mill, thereby manufacturing the Fe metallic magnetic powder having a Vickers hardness of 350 Hv. 7% by weight of forsterite having an average particle diameter of 4 μm and a compressive strength of 5900 kg/cm$^2$ is weighed and mixed with 100% by weight of the metallic magnetic powder having an improved hardness as the inorganic insulating material. After that, the inorganic insulating material is dispersed on the surface of the metallic magnetic powder particles using a MECHANO FUSION, thereby manufacturing a complex magnetic powder. 12% by volume of a butyral resin is mixed with 100% by volume of the complex magnetic powder as the thermosetting resin, thereby manufacturing a compound. The obtained compound is pressed with a molding pressure of 4 ton/cm$^2$ so as to manufacture a compact. The compact is subjected to a thermosetting treatment at 150° C. for 2 hours so as to manufacture a dust core for magnetic properties evaluation and a specimen for voltage resistance evaluation.

Meanwhile, the method of evaluating the hardness of the metallic magnetic powder, the compressive strength of the inorganic insulating material, the shape of the obtained dust core, the shape of the specimen, and the electrical resistivity is carried out under the same conditions as described above. With regard to the direct current superposition characteristics, an inductance value at an applied magnetic field of 55 Oe, a frequency of 300 kHz, and a turn number of 20 is measured using an LCR meter (manufactured by HP company; 4294A), and a magnetic permeability is computed from the obtained inductance value and the specimen shape of the dust core. With regard to the magnetic loss, measurement is carried out at a measurement frequency of 300 kHz, and a measurement magnetic flux density of 25 mT using an alternative current B—H curve analyzer (manufactured by Iwatsu Test Instruments Corporation; SY-8258). The obtained evaluation results are shown in Table 4.

TABLE 4

| No | Average particle diameter of the metallic magnetic powder (μm) | Packing factor (%) | Permeability (550e) | Magnetic loss (kW/m$^3$) | Dielectric strength voltage (V/mm) | |
|---|---|---|---|---|---|---|
| 51 | 0.5 | 61.3 | 11 | 1420 | <1.E+05 | Comparative example |
| 52 | 1 | 65.2 | 16 | 1260 | 1.E+06 | Example |
| 53 | 5 | 69.8 | 19 | 1050 | 1.E+07 | Example |
| 54 | 10 | 72.5 | 23 | 950 | 1.E+07 | Example |
| 55 | 50 | 75.2 | 29 | 925 | 1.E+07 | Example |
| 56 | 100 | 78.5 | 34 | 930 | 1.E+07 | Example |
| 57 | 120 | 80.1 | 37 | 1650 | 1.E+07 | Comparative example |

Nos. 51 to 57 show that favorable direct current superposition characteristics and low magnetic loss are exhibited when the average particle diameter of the metallic magnetic powder is 1 μm to 100 μm. Therefore, it is found that the average particle diameter of the metallic magnetic powder that is used is preferably 1.0 μm to 100 μm.

When the average particle diameter of the metallic magnetic powder is smaller than 1.0 μm, a high packing factor cannot be obtained such that the direct current superposition characteristics are degraded, which is not preferable. In addition, when the average particle diameter of the metallic magnetic powder is larger than 100 μm, the eddy-current loss becomes large in a high frequency range, which is not preferable. A more preferable range is 1 μm to 50 μm.

As described above, the dust core of the invention is a dust core including metallic magnetic powder, an inorganic insulating material, and a thermosetting resin, in which the metallic magnetic powder has a Vickers hardness (Hv) in a range of 230≦Hv≦1000, the inorganic insulating material has a compressive strength of 10000 kg/cm$^2$ or lower and is in a mechanical collapse state, and the inorganic insulating material in a mechanical collapse state and the thermosetting resin are interposed between the metallic magnetic powder particles.

In addition, the metallic magnetic powder of the dust core according to the invention includes at least one kind of Fe—Ni-based, Fe—Si—Al-based, Fe—Si-based, Fe—Si—Cr-based, and other Fe-based metallic magnetic powder.

In addition, the average particle diameter of the metallic magnetic powder of the dust core according to the invention is 1 μm to 100 μm.

In addition, the dust core according to the invention has the inorganic insulating material mixed in 1% by volume to 15% by volume with respect to 100% by volume of the metallic magnetic powder.

In addition, the dust core according to the invention has a packing factor of the metallic magnetic powder of 65% to 82% by volume conversion.

In addition, the dust core according to the invention has an electrical resistivity of $10^5$ Ω·cm or higher.

Therefore, according to the invention, it is possible to provide a dust core having excellent magnetic properties and high voltage resistance even after a high-temperature heat resistance test.

In addition, such a dust core can realize a magnetic element that is sufficiently applicable for the miniaturization, large electric current, an increase in the voltage resistance of a coil-buried choke coil and the like, and use in a high-frequency range.

INDUSTRIAL APPLICABILITY

According to the dust core of the invention and a magnetic element using the same, the dust core can counteract a large electric current, achieve an increase in frequency and miniaturization, and achieve an increase in voltage resistance, thereby being useful for a variety of electronic devices.

The invention claimed is:

1. A dust core comprising a metallic magnetic powder, an inorganic insulating material, and a thermosetting resin, wherein the metallic magnetic powder has a Vickers hardness (Hv) in a range of 230≦Hv≦1000, the inorganic insulating material has a compressive strength of 10000 kg/cm$^2$ or lower and is in a mechanical collapse state, and the inorganic insulating material in a mechanical collapse state and the thermosetting resin are interposed between the metallic magnetic powder particles.

2. The dust core of claim 1, wherein the metallic magnetic powder includes at least one kind of Fe—Ni-based, Fe—Si—Al-based, Fe—Si-based, Fe—Si—Cr-based, and other Fe-based metallic magnetic powder.

3. The dust core of claim 1, wherein the average particle diameter of the metallic magnetic powder is 1 μm to 100 μm.

4. The dust core of claim 1, wherein 1% by volume to 15% by volume of the inorganic insulating material is mixed with respect to 100% by volume of the metallic magnetic powder.

5. The dust core of claim 1, wherein the packing factor of the metallic magnetic powder is 65% to 82% by volume conversion.

6. The dust core of claim 1, wherein the electrical resistivity is $10^5$ Ω·cm or higher.

7. A magnetic element having a coil buried in the dust core of claim 1.

* * * * *